United States Patent [19]

Durville et al.

[11] 4,037,434

[45] July 26, 1977

[54] CLOSED CAM TRACK FOR A CIRCULAR KNITTING MACHINE

[75] Inventors: Gerard Durville, Geneva, Switzerland; Charles Hamilton Wunner, Charlotte, N.C.

[73] Assignee: The Singer Company, New York, N.Y.

[21] Appl. No.: 670,802

[22] Filed: Mar. 26, 1976

[51] Int. Cl.[2] ..... D04B 15/32

[52] U.S. Cl. ..... 66/57

[58] Field of Search ..... 66/57, 78

[56] References Cited

U.S. PATENT DOCUMENTS

| | | | |
|---|---|---|---|
| 846,430 | 3/1907 | Scott | 66/57 |
| 1,056,691 | 3/1913 | Kimes | 66/57 X |
| 2,084,770 | 6/1937 | Larkin | 66/57 X |
| 2,966,782 | 1/1961 | Deiss et al. | 66/57 X |
| 3,800,561 | 4/1974 | Beuter et al. | 66/57 |

FOREIGN PATENT DOCUMENTS

| | | | |
|---|---|---|---|
| 2,242,169 | 3/1974 | Germany | 66/57 |
| 2,225,865 | 12/1972 | Germany | 66/57 |
| 1,398,602 | 6/1975 | United Kingdom | 66/57 |

*Primary Examiner*—Mervin Stein
*Assistant Examiner*—A. M. Falik
*Attorney, Agent, or Firm*—Edward L. Bell; Robert E. Smith; William V. Ebs

[57] ABSTRACT

A circular knitting machine is provided with cam section blocks defining a closed needle butt cam track with upper and lower arcuate portions.

7 Claims, 2 Drawing Figures

Fig.1
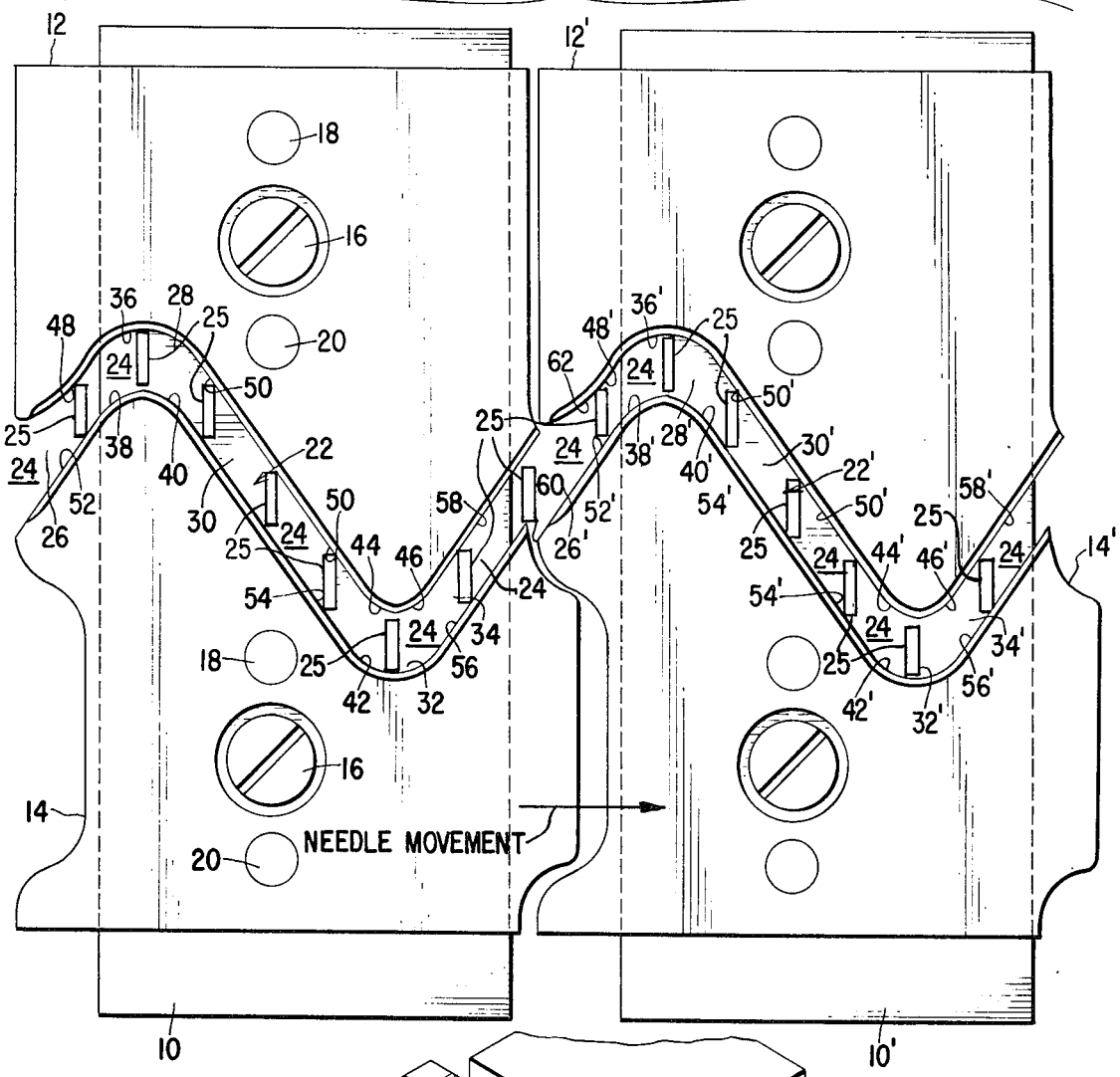
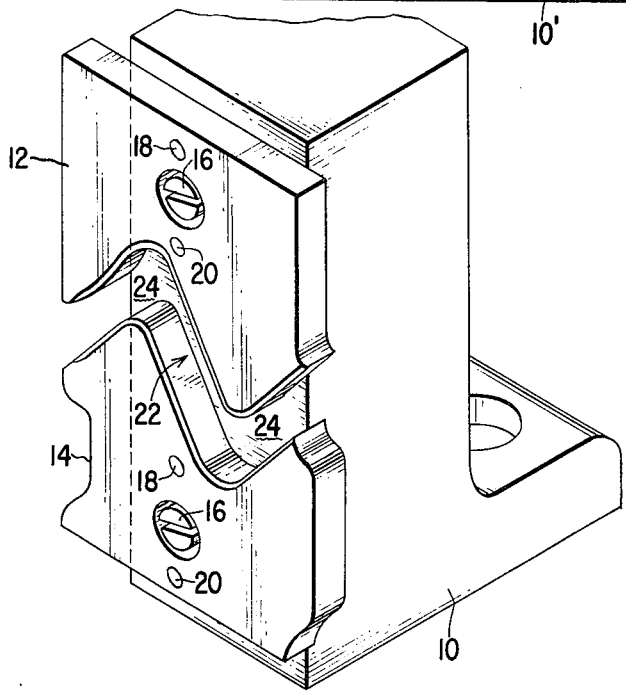
Fig.2

CLOSED CAM TRACK FOR A CIRCULAR KNITTING MACHINE

BACKGROUND OF THE INVENTION

1. Field of the Invention.

This invention relates to needle actuating camming for knitting machines, and especially to needle actuating camming for high speed circular knitting machines.

2. Description of the Prior Art

It has been the practice to provide separate raise and stitch cams in circular knitting machines for raising and lowering knitting needles and to permit needles to move between the raise and stitch cams without being positively controlled. Large impact forces resulted whenever a needle butt first engaged a raise cam after leaving a stitch cam, or first engaged a stitch cam after leaving a raise cam, and the cam surface as well as the needle butts sustained excessive wear and damage and a consequence. Such impact forces increase with increased speeds and it therefore became necessary to run machines at quite limited speeds in order to prevent frequent shut-downs for repair. Also in the extent to which there was a lack of positive control of needles by a closed cam track closely confining needle butts as they were actuated by raise and stitch cams, needle butts tended to bounce off the surfaces of raise and stitch cams and of guard cams causing excessive vibration, noisy operation of the machine and excessive wear and damage to the engaging parts.

SUMMARY OF THE INVENTION

In accordance with the invention a knitting machine is provided with a closed cam track for the butts of knitting needles. The track includes needle raising portions and needle lowering portions as well as bridging portions which provide a smooth transition for needle butts moving between the raising and lower portions of the track and minimizes forces on the needle butts. The bridging portions are each defined by a circular arc on one side of the track and two circular arcs on the opposite side, having the same radius as the circular arc on the said one side.

DESCRIPTION OF THE DRAWINGS

FIG. 1 is an elevational view showing a cam track according to the invention on adjacent cam section blocks of a circular knitting machine.

FIG. 2 is a perspective view of one of the cam section blocks of FIG. 1.

DESCRIPTION OF THE PREFERRED EMBODIMENT

Referring to the drawings, reference character 10 designates a cam section block of a circular knitting machine. Cam face plates 12 and 14 are each secured to block 10 as by a screw 16 and held against angular movement as by locating pins 18 and 20. Such face plates 12 and 14 on section block 10 and corresponding other face plates on other section blocks such as the face plates 12' and 14' secured to cam section block 10' disposed adjacent to the section block 10 define like portions such as 22 and 22' of a closed cam track 24 for needle butts 25 around the cylinder of a machine.

Each of the like parts such as 22 and 22' of the closed cam track 24 as viewed from left to right in the drawing includes a generally straight ascending portion, an upper curved bridging portion, a straight descending portion, a lower curved bridging portion, and a straight ascending portion. Reference characters 26, 28, 30, 32 and 34 designate the generally ascending portion, the upper bridging portion; the straight descending portion, the lower bridging portion and the straight ascending portion respectively of the cam track 24 as formed by face plates 12 and 14, and referenced characters 26', 28', 30', 32' and 34' designate corresponding portions of the cam track formed by face plates 12' and 14'.

Each upper bridging portion of the cam track 24 is defined by an upper circular arc such as arc 36 and arc 36' of bridging portions 28 and 28' respectively, and by the two lower circular arcs such as the arcs 38 and 40 of the bridging portion 28 and the arcs 38' and 40' of the bridging portions 28'. Each lower bridging portion of the camming track 24 is defined by a lower circular arc such as arc 42 of bridging portion 32 and arc 42' of bridging portion 32', and by two upper circular arcs such as arcs 44 and 46 of bridging portion 32 and the arcs 44' and 46' of the bridging portion 32'.

All circular arcs such as 36, 38, 40, 36', 38' and 40' of the upper bridging positions of the closed cam track have the same radius. The top circular arc of each upper bridging portion is tangent on one side to a line defining the upper edge of the adjacent generally straight portion of the cam track, and on the other side is tangent to a line defining the adjacent upper edge of the straight descending portion of the track. One circular arc at the bottom side of each upper bridging portion of the track is tangent to the line defining the lower edge of the adjacent generally ascending portion of the cam track and the other circular arc at the bottom of each upper bridging portion of the track is tangent to a line defining the bottom edge of the adjacent portion of the cam track. Arc 36 for example is tangent to line 48 defining the upper edge of ascending portion 26 of the cam track and to line 50 defining the upper edge of the descending portion 30 of the cam track. Arc 38 is a tangent to line 52 defining the lower edge of generally ascending portion 26 and arc 40 is tangent to line 54 defining the lower edge of the straight descending portion 30. Similarly arc 36' is tangent to line 48' defining the upper edge of ascending portion 26' of the cam track and to line 50' defining the upper edge of the descending portion 30' of the cam track, whereas arc 38' is tangent to line 52' defining the lower edge of generally ascending portion 26' and arc 40' is tangent to line 54' defining the lower edge of the straight descending portion 30'.

All circular arcs such as 42, 44, 46, 42', 44' and 46' of the lower bridging portions of the closed cam track have the same radius which is slightly less than the radius of the circular arcs at the upper bridging portions of the closed track. The bottom circular arc of each lower bridging portion is tangent on one side to a line defining the lower edge of the descending portion of the cam track, and on the other side is tangent to a line defining the adjacent lower edge of the straight ascending portion of the track. One circular arc at the top side of each lower bridging portion of the track is tangent to the line defining the upper edge of the adjacent descending straight portion of the track and the other circular arc at the bottom of each lower bridging portion of the track is tangent to a line defining the upper edge of the adjacent ascending portion of the track. Arc 42, for example, tangent to line 54 defining the lower edge of the descending portion of the track and to a line 56 defining the lower edge of the adjacent ascending portion of the track. Arc 44 is tangent to line 50 defining the upper edge of the descending portion of the track and arc 46 is tangent to a line 58 defining the upper edge of the adjacent ascending portion of the track. Similarly, arc 42' is tangent to line 54' defining the lower edge of the descending portion of the track and to a line 56' defining the lower edge of the adjacent ascending portion of the track. Arc 44' is tangent to line 50' defining the upper edge of the descending portion of the track and arc 46' is tangent to line 58' defining the upper edge of the adjacent ascending portion of the track.

The initial ascending portion of the cam track on each section block is out-of-alignment with the terminal ascending portion of the track in the adjacent cam section block. As shown such initial ascending portions of the cam track are offset as at 60 in the down direction from the terminal ascending portions of the track. The lower edge of each initial ascending portion of the track is therefore lower than the lower edge of the adjacent terminal portion of the track at the point where a needle butt 25 leaves one cam section block and enters the next section block. In addition the upper edge of each initial ascending track portion is flared as at 62 so as to cause it to extend above the upper edge of the adjacent terminal ascending portion of the track in the region where a needle butt leaves one cam section block and enters the next. The downward displacement of the terminal ascending positions of the track with respect initial ascending portions of the track and the flaring of the upper side of the initial ascending portions as described assures freedom of movement of needle butts between cam sections blocks despite dimensional variations within prescribed limits in the width of the track or in the section blocks.

Although the invention has been described in its preferred form with certain degree of particularity, it is to be understood that the present disclosure of the preferred form has been made by way of example only and that numerous changes in the details of construction and the combination of parts may be resorted to without departing from the spirit and scope of the invention.

Having thus set forth the nature of the invention, what is claimed herein is:

1. Needle actuating camming for a circular knitting machine defining a closed cam track with opposite sides to engage the butts of needles and alternately move the needles repeatedly between cast-off and latch clear positions, the cam track including straight needle raising portions, straight needle lowering portions, and curved bridging track portions between the raising and lowering portions of the track, the bridging portions each having one side defined by a single circular arc which is tangent to a corresponding one side of each of a raising and a lowering portion of the closed cam track, and having an opposite side which is defined by two circular arcs both with a radius equal to the first mentioned circular arc and with one of such two circular arcs tangent to the raising portion of the closed cam track on the side opposite the said one side thereof, the other being tangent to the lowering portion of the track on the side opposite its said one side.

2. The combination of claim 1 wherein grooves in adjacent cam section blocks define the closed cam track.

3. The combination of claim 2 wherein the terminal portion of a groove in each cam section block and initial portion of a groove in an adjacent cam section block are misaligned.

4. The combination of claim 3 wherein said terminal portion of a groove in one cam section block and initial portion of a groove in an adjacent cam section block are ascending portions of the cam track.

5. The combination of claim 2 wherein each cam section block includes an initial ascending portion of the cam track, a descending portion of the cam track, a terminal ascending portion of the cam track, an upper bridging portion between the initial ascending and descending portions of the track, and a lower bridging portion between the descending and terminal ascending portions.

6. The combination of claim 1 wherein the radii of the arcs of the upper bridging portions of the track differ from the radii of the arcs of the lower bridging portions of the track.

7. The combination of claim 4 wherein the radii of the arcs of the upper bridging portions of the tracks are greater than the radii of the arcs of the lower bridging portions of the track.

* * * * *